US010485348B1

(12) United States Patent
Olarte

(10) Patent No.: US 10,485,348 B1
(45) Date of Patent: Nov. 26, 2019

(54) FOLDING CHAIR WITH REDUCED FOOTPRINT

(71) Applicant: Alvaro Mauricio Olarte, Aventura, FL (US)

(72) Inventor: Alvaro Mauricio Olarte, Aventura, FL (US)

(73) Assignee: Series International, LLC, Aventura, FL (US)

( * ) Notice: Subject to any disclaimer, the term of this patent is extended or adjusted under 35 U.S.C. 154(b) by 0 days.

(21) Appl. No.: 16/434,386

(22) Filed: Jun. 7, 2019

Related U.S. Application Data

(60) Provisional application No. 62/682,460, filed on Jun. 8, 2018.

(51) Int. Cl.

| | |
|---|---|
| ***A47C 1/024*** | (2006.01) |
| ***A47C 1/12*** | (2006.01) |
| ***A47C 1/121*** | (2006.01) |
| ***A47C 7/56*** | (2006.01) |
| ***A47C 7/58*** | (2006.01) |

(52) U.S. Cl.
CPC ..... *A47C 1/121* (2013.01); *A47C 7/563* (2013.01); *A47C 7/58* (2013.01)

(58) Field of Classification Search
CPC ..... A47C 1/12; A47C 1/121; A47C 1/023; A47C 1/03; A47C 1/16
See application file for complete search history.

(56) References Cited

U.S. PATENT DOCUMENTS

| | | | | |
|---|---|---|---|---|
| 3,594,037 A | | 7/1971 | Sherman | |
| 3,762,766 A | * | 10/1973 | Barecki | B64D 11/06 297/217.1 |
| 3,976,326 A | * | 8/1976 | Grumblatt | A47C 1/12 297/333 |
| 4,799,632 A | | 1/1989 | Baymak et al. | |
| 5,288,128 A | * | 2/1994 | Smith | A47C 1/121 297/248 |
| 5,328,231 A | * | 7/1994 | Raymond | A47C 1/12 297/13 |

(Continued)

FOREIGN PATENT DOCUMENTS

| | | | |
|---|---|---|---|
| DE | 102007024550 | A1 | 11/2008 |
| WO | 2007034007 | A1 | 3/2007 |
| WO | 2013172529 | A1 | 11/2013 |

OTHER PUBLICATIONS

Folding Wall Seat by Lapoup, Fantastic Folding Wall Seat Images—The Best Bathroom Ideas—lapoup.com, pp. 1-56, May 10, 2018.

*Primary Examiner* — Shin H Kim
(74) *Attorney, Agent, or Firm* — St. Onge Steward Johnston & Reens, LLC

(57) ABSTRACT

A chair including a support, a backrest with a backrest frame hingedly connected to the support, a seat bottom with a seat frame hingedly connected to the backrest and a bracket extending rearward from the seat frame, a linkage arm with a proximal end hingedly connected to the support at a fixed vertical position and a distal end hingedly connected to the bracket, and a return mechanism. Rotation of the seat bottom from a closed position to an open position causes, by way of interaction between the linkage arm and the bracket, the seat bottom to move forward from the support and the backrest to rotate about the support and recline.

27 Claims, 25 Drawing Sheets

(56) References Cited

U.S. PATENT DOCUMENTS

| | | | | | |
|---|---|---|---|---|---|
| 5,567,016 | A * | 10/1996 | Koprowski | A47C 1/12 | 297/411.32 |
| 5,681,085 | A * | 10/1997 | Nahoul | A47C 1/12 | 297/302.1 |
| 6,296,315 | B1 * | 10/2001 | Jensen | A47C 1/121 | 297/232 |
| 6,942,295 | B1 * | 9/2005 | Lopez | A47C 1/024 | 267/141.1 |
| 7,073,858 | B2 * | 7/2006 | Fisher | A47C 1/12 | 297/232 |
| 7,150,498 | B2 | 12/2006 | Svartvatn | | |
| 7,469,966 | B1 | 12/2008 | Vallee | | |
| 7,562,937 | B2 * | 7/2009 | Baumann | B60N 2/242 | 297/452.18 |
| 7,774,880 | B1 * | 8/2010 | Botts | A47C 7/021 | 297/228.1 |
| 8,091,945 | B2 * | 1/2012 | Hancock | B60N 2/3011 | 296/65.06 |
| 2003/0047976 | A1 * | 3/2003 | Hannon | A47C 1/12 | 297/331 |
| 2004/0084943 | A1 * | 5/2004 | Fisher | A47C 1/121 | 297/335 |
| 2005/0146180 | A1 * | 7/2005 | Fisher | A47C 1/12 | 297/248 |
| 2006/0238004 | A1 * | 10/2006 | Conner | A47C 1/121 | 297/216.14 |
| 2006/0244301 | A1 * | 11/2006 | Jeffries | A47C 1/12 | 297/452.55 |
| 2009/0273211 | A1 * | 11/2009 | Hancock | B60N 2/3011 | 297/13 |
| 2016/0331143 | A1 * | 11/2016 | Johnson | A47C 7/56 | |
| 2018/0177300 | A1 * | 6/2018 | Jacobs | A47C 4/06 | |

* cited by examiner

FOLDING CHAIR WITH REDUCED FOOTPRINT

FIELD OF THE INVENTION

The invention relates to chairs, and more specifically to a folding chair with a reduced footprint.

BACKGROUND OF THE INVENTION

Chairs in waiting areas, airports, stadiums, theaters and other spaces are often built with the capability of the seat to fold. This reduces the space taken up when the seat bottom is folded and allows for occupants to enter and exit a row of seating with greater ease. But, in many cases, chairs still project relatively far forward into the aisle or other area even when folded, thus resulting in a waste of area available for other purposes. When chairs are arranged in rows, such as in a theater, the space taken up by each chair in the folded position limits the number of rows that can be placed in the theater. Chairs often also recline backwards which, when arranged in rows, inhibits walking and sitting space behind the chairs.

U.S. Pat. No. 3,594,037 to Sherman discloses a seat designed for a cabin attendant in an aircraft. While it has a relatively thin profile when folded, it requires a complicated series of support links, push rods, rollers and guides to accomplish this. U.S. Pat. No. 4,799,632 to Baymak et al. discloses another seat for attendants in an aircraft. The seat bottom is attached to a fixed hinge and the backrest is attached the seat bottom. However, configuring the seat requires several actions of rotating the seat bottom, pulling the seat bottom outward to extend it, and pulling the backrest forward to recline. These seats are not conducive to use in theater applications.

U.S. Pat. No. 7,469,966 to Vallee discloses a chair having a seat that folds down about a horizontal axle. Though offering a simpler design, the backrest is reclined by having a titled frame which sacrifices space.

WO2007034007 to Figueras Mitjans discloses a folding chair with a seat part and a backrest which are independent of one another. Plates positioned between the seat part and the backrest are equipped with pins which are inserted into recesses in lateral supports to form a tilting assembly. The pivot is fixed and there is no return mechanism to control the rate of the seat closing. In use, the seat extends backward. WO2013172529 to Ham discloses a similar chair in which the backrest tilts backwards reducing space behind the chair. When multiple chairs are arranged in rows, such as in a theater, such configurations inhibit space walking and sitting space behind each chair.

Therefore, it is desired to provide a seat that provides for adequate seating space and comfort while reducing the footprint required.

SUMMARY OF THE INVENTION

Accordingly, it is an object of the present invention to provide a folding chair with a reduced footprint.

These and other objects are achieved by providing a chair having a base and a pedestal which extends upwards from the base to a cradle having a width. The cradle holds a backrest and a seat bottom, and the seat bottom pivots relative to the cradle such that in the closed position, the width between the rear surface of the backrest and bottom surface of the seat is approximately equal to or less than a width of the cradle. In some embodiments, the pedestal, backrest, and seat bottom are parallel in the closed position.

Further provided is a chair, including a support, a backrest including a backrest frame hingedly connected to the support, a seat bottom including a seat frame, hingedly connected to the backrest, and a bracket extending from a rear portion of the seat frame, a linkage arm with a proximal end hingedly connected to the support and a distal end hingedly connected to the bracket, and a return mechanism to return the seat bottom from an open position to a closed position. Rotation of the seat bottom from a closed position to an open position causes, by way of interaction between the linkage and the bracket, the seat bottom to move forward from the support and the backrest to rotate about the support and recline. The bottom portion of the backrest may include a cradle rigidly connected thereto, wherein the seat bottom is hingedly attached to the backrest via the cradle, the cradle being movable with respect to the support via the hinged connection between the backrest frame and the support.

In some embodiments, in the closed position, the bracket is within the cradle and the linkage arm is at least partially within the cradle. In some embodiments, the support is a pedestal including a base mountable to a surface below the chair. In other embodiments, the support is a plate mountable against a vertical surface.

In some embodiments, the chair also has an armrest including a top section pivotably connected to a side of the backrest, and a bottom section pivotably connected at first end to the top section and pivotably connected at a second end to the seat bottom.

In some embodiments the return mechanism has a linkage with a pivot at either end thereof, a first end of the linkage is hingedly connected at its pivot to a resilient element and a second end of the linkage is hingedly connected at its pivot to the seat frame. In certain embodiments, the resilient element is a gas spring. The gas spring may be is mounted within the backrest frame and the linkage can move in and out of the backrest frame as the chair moves between open and closed positions. In certain aspects the pivot of the second end is connected to a bracket which is connected to the seat frame.

Further provided is a chair including a support having a front surface and a rear surface, a backrest adjacent to the front surface of the support and hingedly connected about a first pivot fixed in position on the support. The backrest is rotatable about the first pivot from an upright position to a reclined position without protruding beyond the rear surface of the support. The chair also includes a second pivot in a bottom portion of the backrest. The seat bottom is rotatable from a stowed position in which a top surface of the seat bottom is adjacent to the backrest to an open position. Rotation of the seat bottom from the stowed position to the open position causes the seat bottom and the second pivot to move forward away from the support and the backrest to rotate about the first pivot to the recline position.

Also provided is a chair including a support, a backrest hingedly connected to a top portion of the support, a cradle rigidly connected to a bottom portion of the backrest, the cradle being movable with respect to the support via the hinged connection between the backrest and the support, a seat bottom hingedly connected to the cradle including a bracket extending from a rear portion of the seat bottom, and a linkage arm with a proximal end hingedly connected to the support and a distal end hingedly connected to the bracket. Rotation of the seat bottom from a closed position to an open position causes, by way of interaction between the linkage arm and the bracket, the seat bottom and the cradle to move forward from the support and the backrest to rotate about the support and recline. A width between a rear surface of the backrest and a bottom surface of the seat bottom in the closed position is equal to or less than a width of the cradle.

Further provided is a row of chairs including a plurality of the chairs mounted side-by-side.

Other objects of the invention and its particular features and advantages will become more apparent from consideration of the following drawings and accompanying detailed description.

BRIEF DESCRIPTION OF THE DRAWINGS

FIG. 1A shows the chair in a closed configuration and FIG. 1B shows the chair in an open configuration.

FIG. 2A shows the chair in a closed configuration and FIG. 2B shows the chair in an open configuration.

FIG. 5A is a front view of the chair and FIG. 5B is a top view of the chair.

FIG. 6A shows the chair in a closed configuration and FIG. 6B shows the chair in an open configuration.

FIG. 7A shows the chairs in closed configurations and FIG. 7B shows the chairs in open configurations.

FIG. 8A is a front view of the chair, FIG. 8B is a side view of the chair, and FIG. 8C is a top view.

FIG. 9A is a cutaway view of the chair in an open configuration. FIG. 9B is a partial assembly view of the chair. FIG. 9C is a detail view of the return mechanism of the chair. FIG. 9D is a cutaway view of the seat bottom. FIG. 9E is a detail view of the interaction between the backrest and seat bottom of the chair.

FIG. 10A shows the chair in a closed configuration and FIG. 10B shows the chair in an open configuration.

FIG. 11A shows the chair in a closed configuration and FIG. 11B shows the chair in an open configuration.

DETAILED DESCRIPTION OF THE INVENTION

Figure 1A:
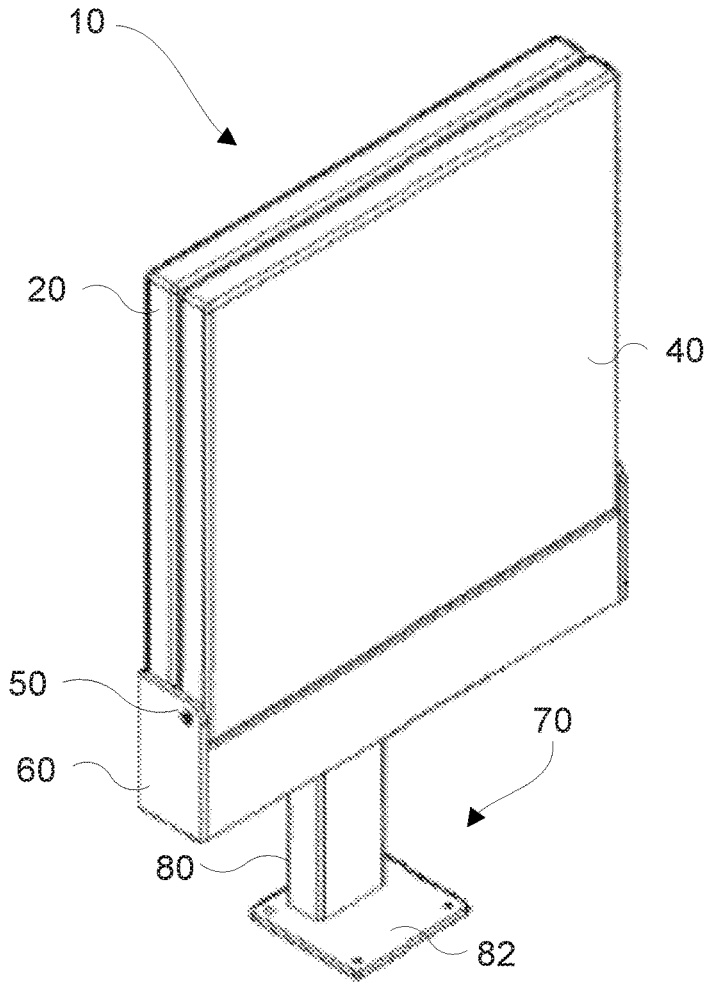
FIGS. 1A and 1B show a chair according to an exemplary embodiment of the present invention mounted on a pedestal.

Referring now to the drawings, wherein like reference numerals designate corresponding structure throughout the views. The following examples are presented to further illustrate and explain the present invention and should not be taken as limiting in any regard.

Figure 1B:
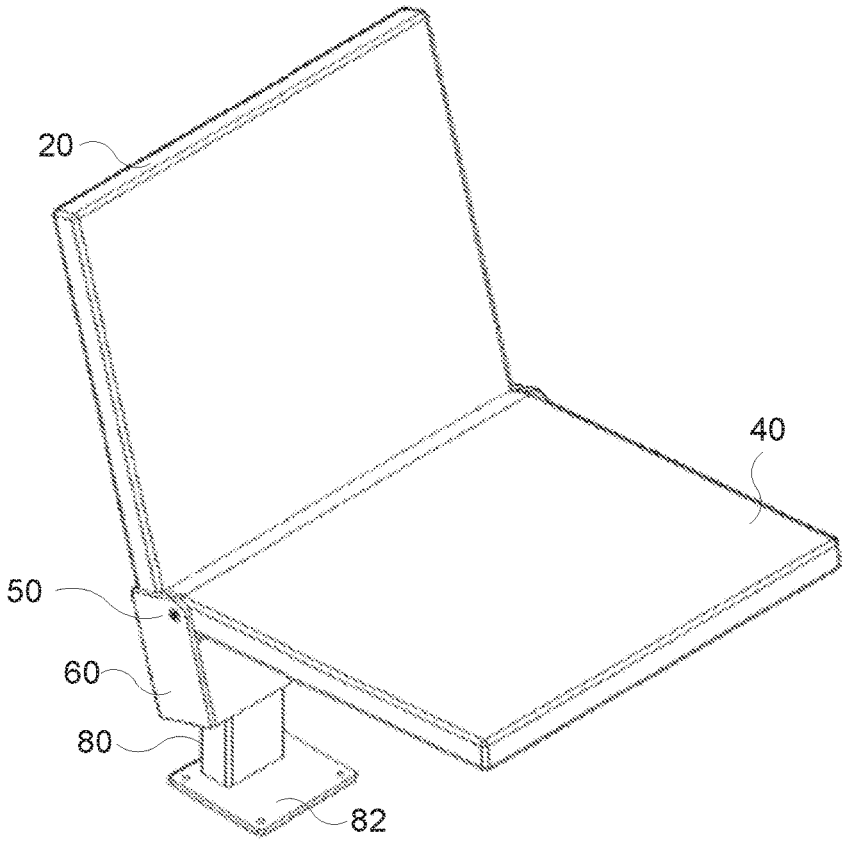

FIGS. 1A and 1B show a chair 10 according to an exemplary embodiment of the present invention mounted or supported on a pedestal 70. FIG. 1A shows the chair 10 in a closed or stowed configuration. The chair includes a backrest or seat back 20 and a seat or seat bottom 40. The seat back 20 and seat bottom 40 are connected via a cradle 60. In this closed configuration, the seat back 20 and seat bottom 40 are in contact with one another and generally vertical. A combined thickness of the seat back 20 and the seat bottom 40 in the closed configuration is generally equal to or less than a width (front to back thickness) of the cradle 60. In one embodiment, the combined thickness (and also the width of the cradle) is less than or equal to four (4) inches. In a preferred embodiment, the combined thickness is three (3) inches or less.

In this exemplary embodiment, the chair 10 is mounted to an arm or pedestal 70 connectable to a surface, such as the floor. The pedestal 70 is comprised of a vertical beam or support 80 and a base 82 which connects to the floor. However, as explained below, the chair 10 may be mounted or supported in other ways. In some embodiments, the vertical support 80 may be mounted to a wall or a riser (step), and/or different supports or mounts may be employed.

The support 80 includes a rear surface (e.g., defining a rear plane) and a front surface adjacent to the seat back 20. The support 80 extends vertically to minimize the space consumed by the chair 10, particularly when a series of the chairs 10 are arranged in rows such as in a theater. As one skilled in the art will understand, the floors in some theaters slope towards the stage thus the support 80 may connect to the base 82 at an angle to allow it to still extend vertically on sloped surfaces.

FIG. 1B shows the chair 10 in an open configuration. The seat bottom 40 rotates about an axis or pivot 50 in the cradle 60. As explained in more detail below, as the seat bottom 40 is rotated downward to an open position, the cradle 60 translates forward allowing the seat back 20 to tilt without inhibiting space behind the chair 10.

Figure 2A:
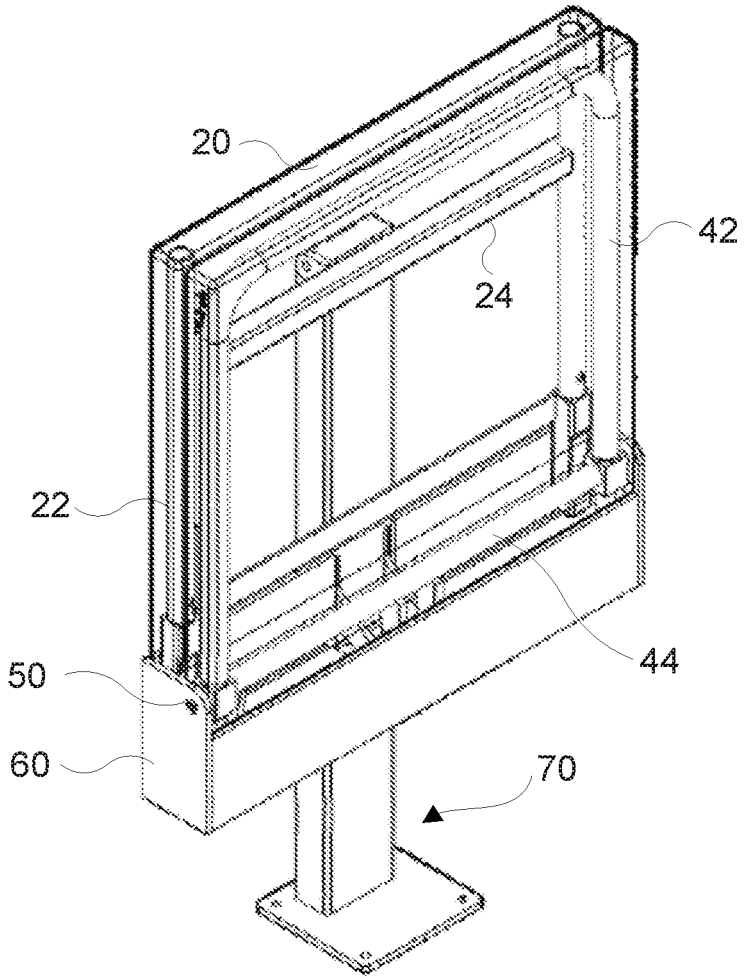
FIGS. 2A and 2B show cutaway views of the chair shown in FIGS. 1A and 1B.
Figure 2B:
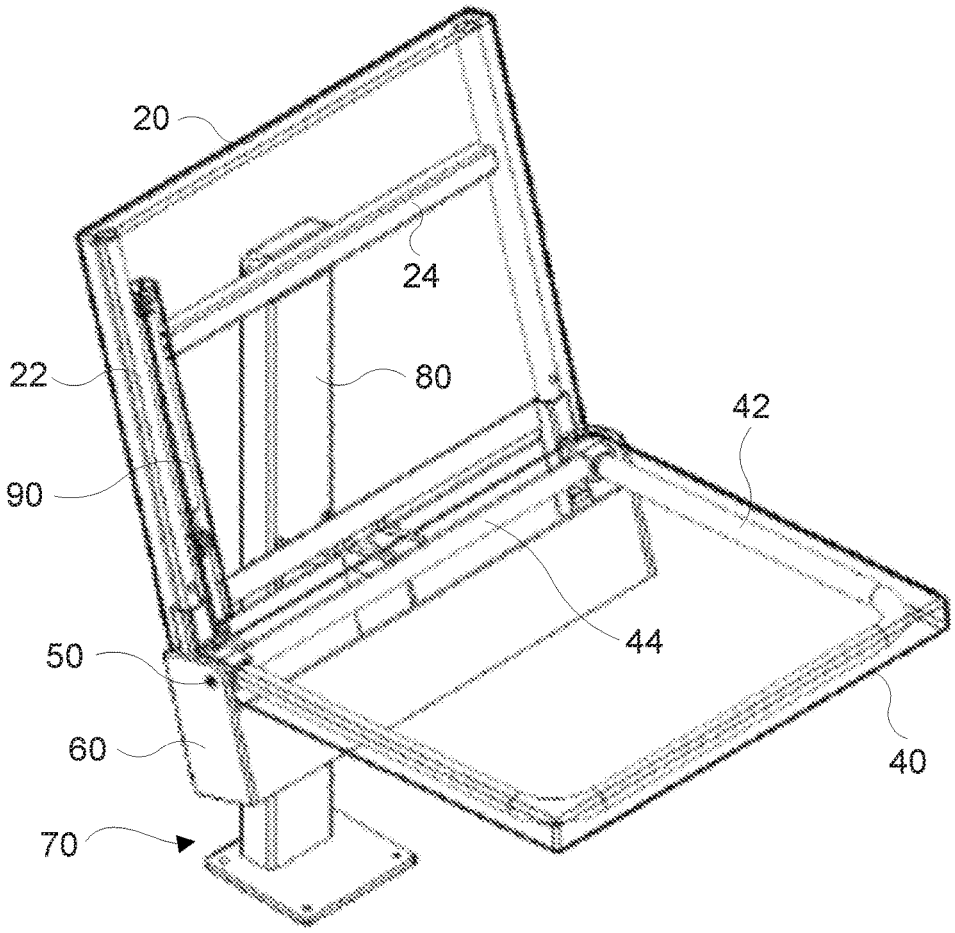

FIGS. 2A and 2B show cutaway views of the chair 10. FIG. 2A shows the chair 10 in a closed (stowed) configuration and FIG. 2B shows the chair 10 in an open configuration. The seat back 20 includes a seat back frame 22. In the exemplary embodiment, it is a tubular (e.g., metal) frame with a square or rectangular cross-section defining a shape and outer envelope of the seat back 20. The frame 22 includes a mounting bar 24, extending from a left frame member to a right frame member, that is pivotably connected to the pedestal 70 allowing the seat back 20 to rotate about a pivot (e.g., the first pivot) on a top of the support 90. In the exemplary embodiment, the mounting bar 24 is below the top of the seat back 20. This allows for the top of the seat back 20 to rotate at least partially over a top the support 80, but preferably within the footprint of the chair 10, i.e., not beyond the plane defined by the rear surface of the support 80 when the chair 10 is in a reclined position.

The seat bottom 40 likewise includes a frame 42 of similar construction. A rear portion or frame member 44 of the frame 42 is pivotably connected to the cradle 60 via the pivot 50 (e.g., the second pivot). The pivot 50 may comprise holes on opposite sides of the cradle 60 receiving pins (50*a*, 50*b*) and/or a pivot rod extending through the cradle 60 between the holes.

The seat back 20 and seat bottom 40 each include a cushion including an outer cover, e.g., comprised of fabric, synthetic materials, and/or leather. Within the cushion are internal materials such as foam and/or webbing or straps extending between the frame members for strength. In some embodiments, the frames 22/42 and/or strength elements are molded within foam.

In some embodiments, the back of the seat back 20 and/or the bottom of the seat bottom 30 are covered with decorative sheets. For example, a continuous sheet may be secured to front and/or rear of the chair with a decorative pattern or wood grain. In some embodiments, the sheet extends over the cradle 60 to give the appearance of a one-piece unit.

As shown in FIG. 2B, the chair 10 may include a return mechanism 90, such as a gas spring or piston, attached within the seat back 20. In the exemplary embodiment, the return mechanism 90 is fixed to a side frame member (left or right) of the frame 22. In other embodiments discussed herein, the return member 90 is within a left and/or right frame member of the frame 22. The return mechanism 90 is connected to an attachment 52 (see FIG. 3) fixed on the rear portion of the seat bottom frame 42. The return mechanism 90 retracts the seat 12 from the open configuration to the closed configuration in a controlled manner. In particular, the return mechanism 90 provides for a smooth and generally constant angular velocity of the seat bottom 40 around the pivot 50.

The seat bottom 40 rotates about ninety (90) to one-hundred and fifteen (115) degrees about the pivot 50 as the seat bottom 40 transitions between the closed configuration and the open configuration. The seat back 40 generally rotates about seven (7) to twenty-two (22) degrees. In an exemplary embodiment, the return action to the closed configuration actuated by the return mechanism 90 takes approximately six (6) to ten (10) seconds. Thus, the return rate of the seat bottom 40 in such embodiment is approximately nine (9) to twenty (20) degrees per second. The return rate of the seat back 20 is about 0.75 to five (5) degrees per second. In other embodiments, the rate of return of the seat bottom 40 is five (5) degrees per second. In other embodiments, the rate of return is up to thirty (30) degrees per second.

Figure 3:
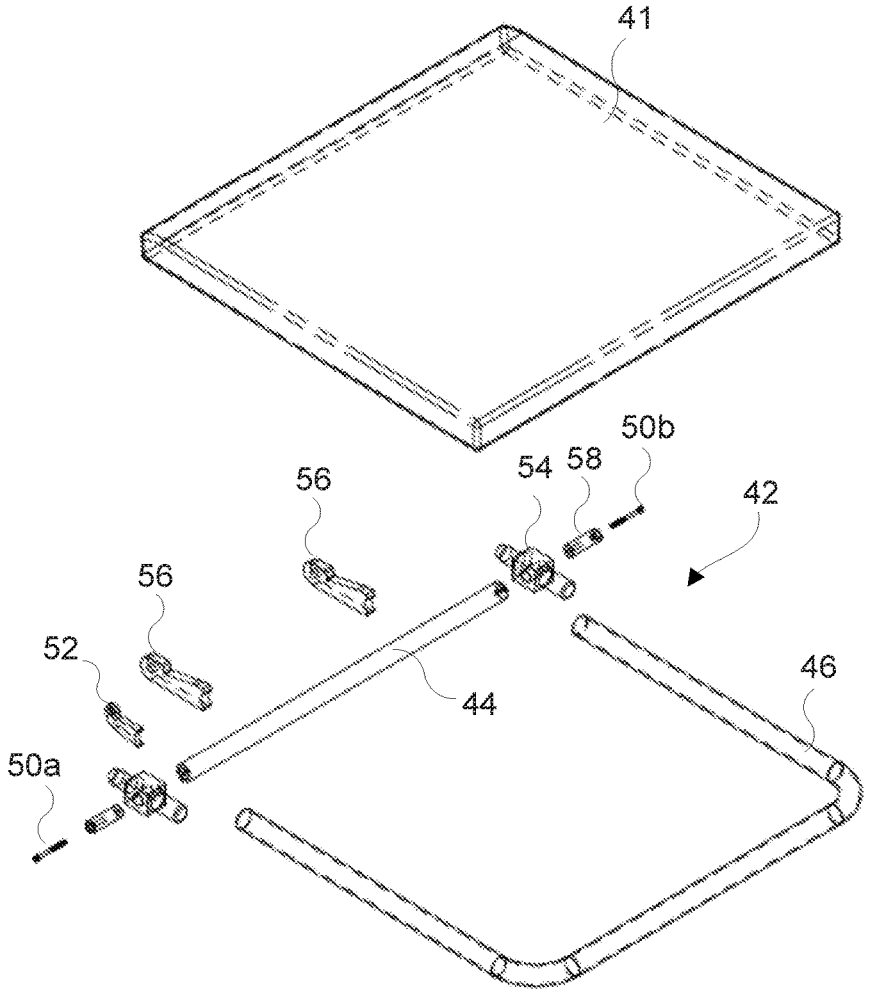
FIG. 3 shows an exploded view of a seat bottom portion of the chair.

FIG. 3 shows an exploded view of one exemplary embodiment of the seat bottom 40 of the chair 10. The seat bottom 40 includes a cushion 41. The rear frame member 44 includes the attachment 52 and at least one bracket 56 rigidly fixed thereto. The attachment 52 and brackets 56 may be formed integrally with the frame member 44 and/or fixed by means known to those of skill in the art such as welding. In the exemplary embodiment, the frame 42 includes side and front frame members 46 which may be a single tubular element and/or separate frame members attached to one another. The frame members 46 may be connected to the rear frame member 42 via joining elements 54. In the exemplary embodiment, the joining elements 54 each include a sleeve 58 for receiving a pin 50*a*/50*b* and allowing for rotation of the seat bottom 40 with respect to the cradle 60. As shown in further embodiments discussed herein, the joining elements 54 may include attachments 52 attached to or formed integrally therewith.

Figure 4:
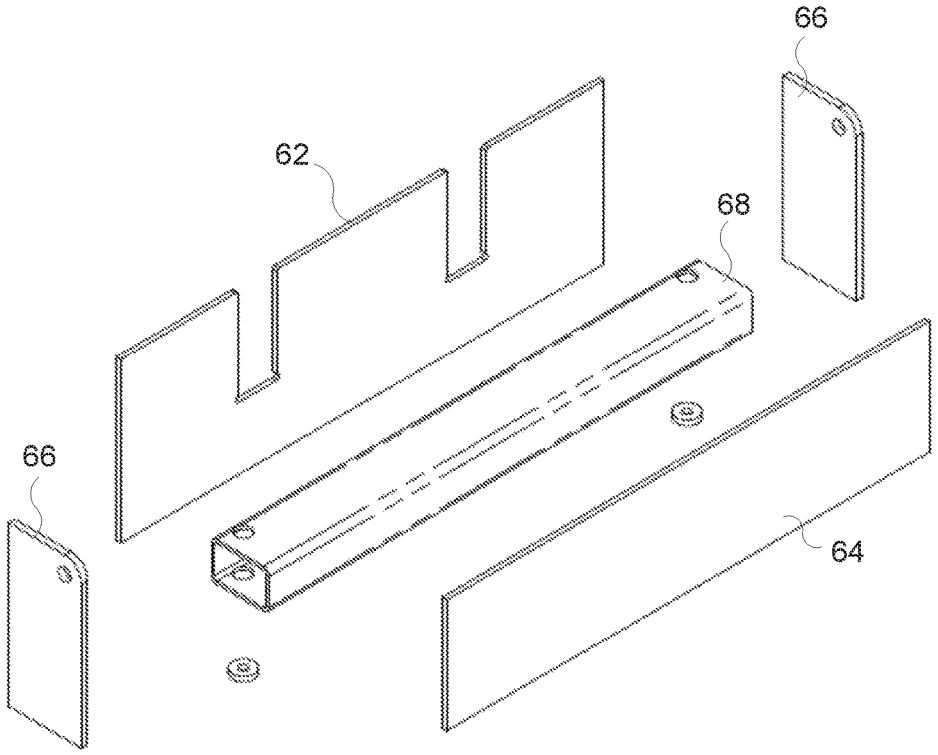
FIG. 4 shows an exploded view of a cradle portion of the chair.

FIG. 4 shows an exploded view of one exemplary embodiment of the cradle 60. The cradle 60 generally includes closed sides and bottom and an open top for receiving the seat back 20 and seat bottom 40. In the exemplary embodiment, the cradle 60 includes a rear panel 62, a front panel 64, and two side panels 66. The bottom is comprised of a tubular element 68 with holes for vertically securing the frame of the seat back 20 to the cradle 60. The components of the cradle 60 may be attached by welding or by fasteners (e.g., bolts), or formed as a single piece by machining or extruding. The rear panel 62 includes slots for receiving linkages 88 as described in more detail below. An additional embodiment of the cradle 60 is shown in FIG. 9B.

Figure 5B:
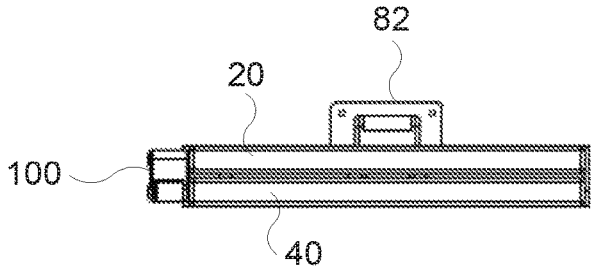
FIGS. 5A and 5B show a chair with a foldable arm rest according to an exemplary embodiment of the present invention.
Figure 5A:
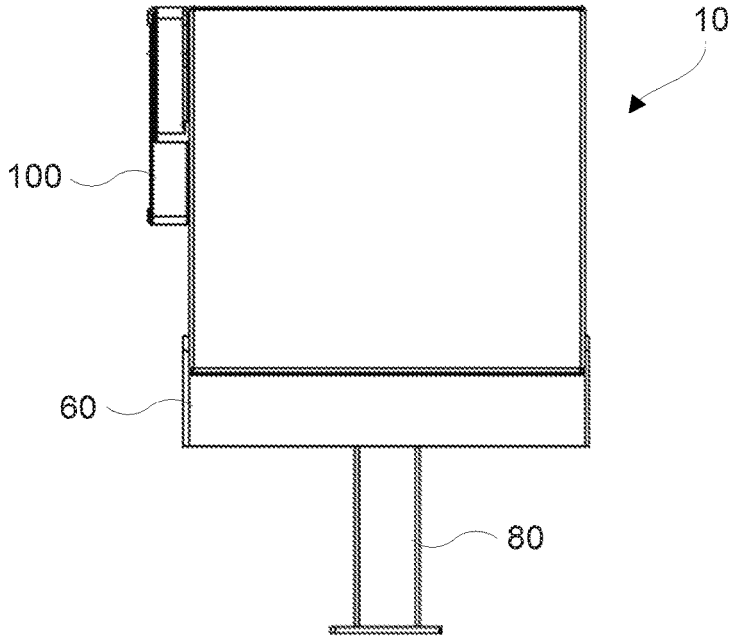

FIGS. 5A and 5B show the chair 10 with a foldable armrest 100 according to an exemplary embodiment of the present invention. FIG. 5A is a front view of the chair 10 and FIG. 5B is a top view of the chair 10. The armrest 100 is attached to one side of the chair 10 between the seat back 20 and the seat bottom 40. As the chair 10 transitions from the closed configuration to the open configuration, the armrest 100 unfolds (and vice versa). The armrest 100 preferably does not increase the thickness of the chair 10 in the closed configuration.

Figure 6A:
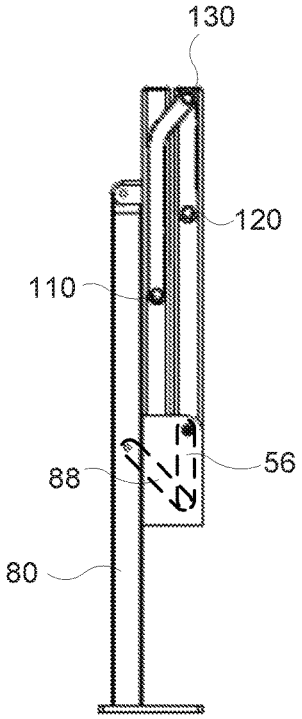
FIGS. 6A and 6B are side views of the chair shown in FIGS. 5A and 5B.
Figure 6B:
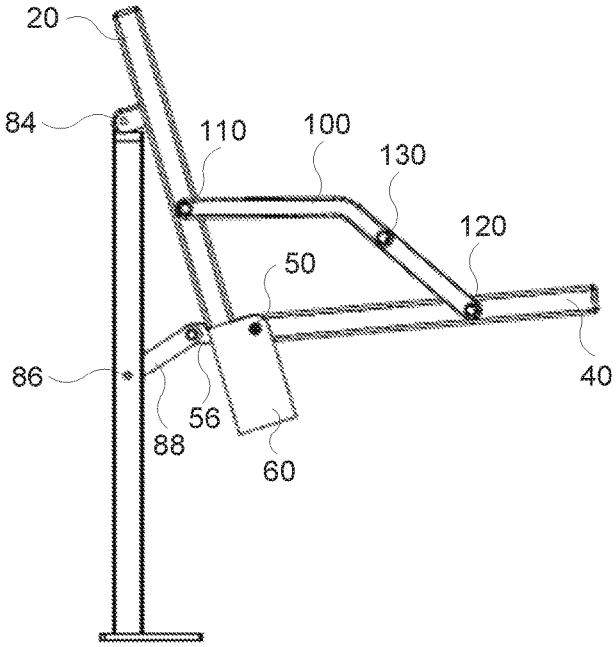

FIGS. 6A and 6B are side views of the chair 10 with the armrest 100. FIG. 6A shows the chair 10 in a closed configuration and FIG. 6B shows the chair 10 in an open configuration. While the armrest 100 is shown, the operation of the chair 10 depicted in FIGS. 6A and 6B and described as follows is instructive for embodiments with and without the armrest 100 and with different supports or mounts.

As the seat bottom 40 is rotated downward about pivot 50 (by a user pulling forward on the seat bottom 40), the cradle 60 translates forward causing the seat back 20 to recline. In particular, there is a linkage or linkage arm 88 rotatably connected at one end to the vertical support 80 of the pedestal 70 via a pivot 86, the pivot 86 being at a fixed vertical position on (e.g., inside of) the support 80, and at the other end to a bracket 56 fixed to the frame of the seat bottom 40. In the exemplary embodiment, there are two linkages 88 (which may be connected to one another) and two brackets 56. In the closed configuration, the linkages 88 are generally concealed within the cradle 60 as shown in FIG. 6A. Thus, in the closed configuration, the components of the tilt/translate mechanism are generally concealed within the cradle 60 which improves both safety and aesthetics.

As shown in FIG. 6B, rotation of the seat bottom 40 downward about the pivot 50 results in the brackets 56 rotating upward. This extends the linkages 88 thereby translating the cradle 60 and seat bottom 40 forward. At the same time, the seat back 20 is caused to rotate about a pivot 84 on the vertical support 80 of the pedestal 70 into a reclined position. In the exemplary embodiment, the cradle 60 and seat back 20 are configured to rotate at least seven (7) degrees, such as at least fifteen (15) degrees or about seventeen (17) degrees. The seat bottom 40 angle change measured relative to the seat back is about eight (8) to fifteen (15) times greater than the seat back angle change measured relative to the mounting surface.

The armrest 100 includes a top portion rotatably connected to the seat back 20 via a pivot 110 in a side frame member of the seat back 20. A bottom portion of the armrest is rotatably connected to the top portion via a pivot 130 and to the seat bottom 40 via a pivot 120 in frame member 46. In the closed configuration, the armrest 100 is collapsed adjacent to the seat back 20 and seat bottom 40 having a thickness that is generally equal to or less than the combined thickness of the seat back 20 and the seat bottom 40 and/or equal or less than the width of the cradle 60. As the seat bottom 40 is rotated downward, the armrest 100 extends into a position for use.

Figure 7A:
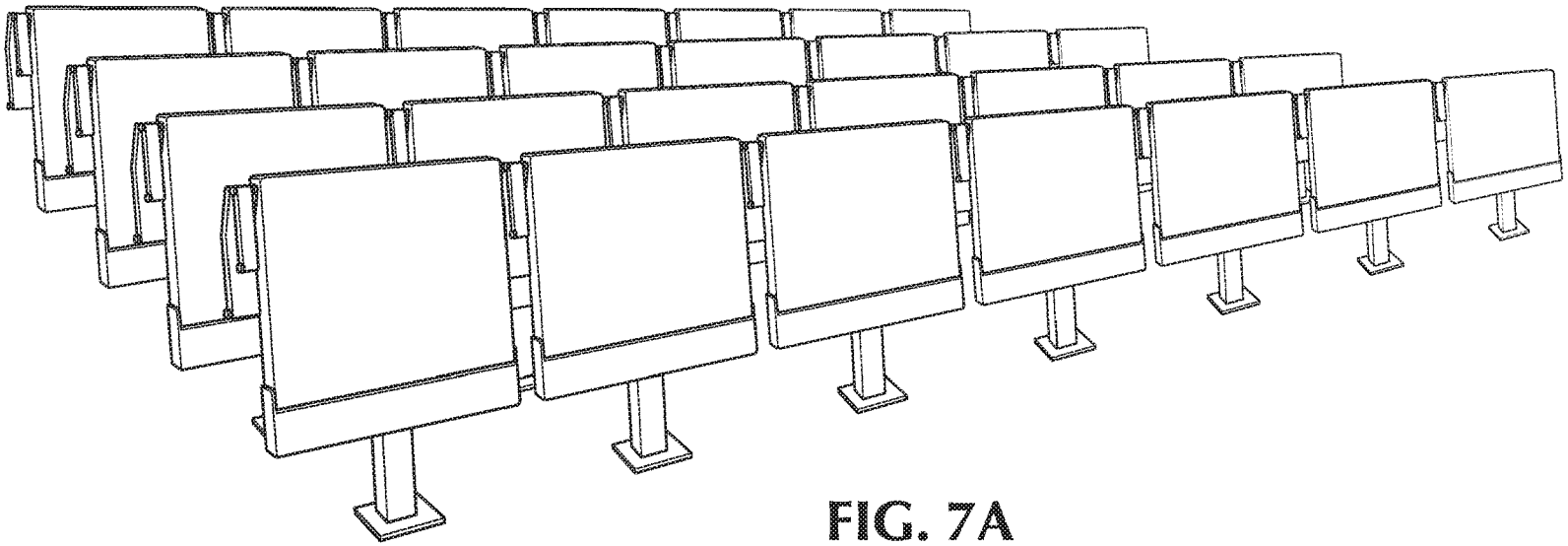
FIGS. 7A and 7B show rows of chairs according to an exemplary embodiment of the present invention.
Figure 7B:
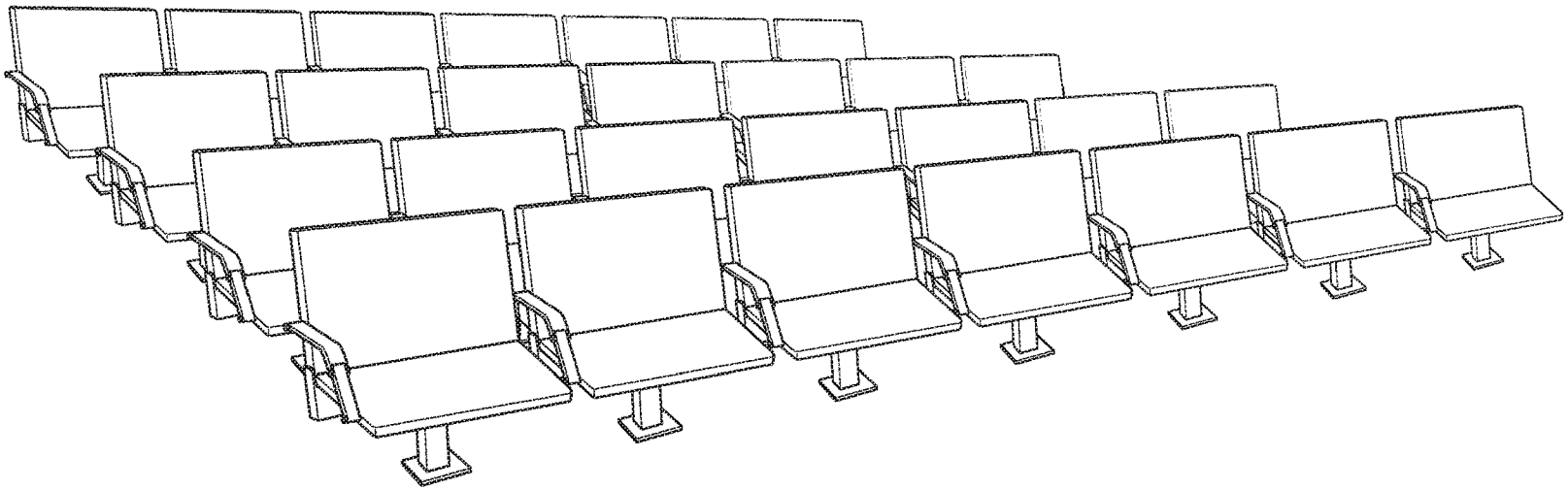

In the exemplary embodiment, the chair 10 has an armrest 100 only on one side. As shown in FIGS. 7A and 7B, this allows for tight spacing of the chairs 10 when arranged side-by-side where the armrest 100 can be shared by adjacent chairs 10. In some embodiments, the chair 10 has an armrest 100 on both sides, such as when a chair 10 is not adjacent to another chair 10 or when it is at the end of a row.

Figure 8C:
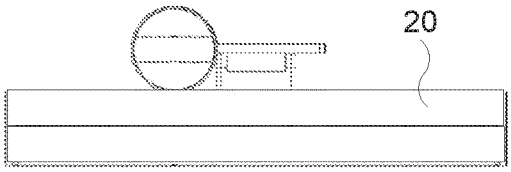
FIGS. 8A to 8C show a chair according to an exemplary embodiment of the present invention mountable on a riser.
Figure 8B:
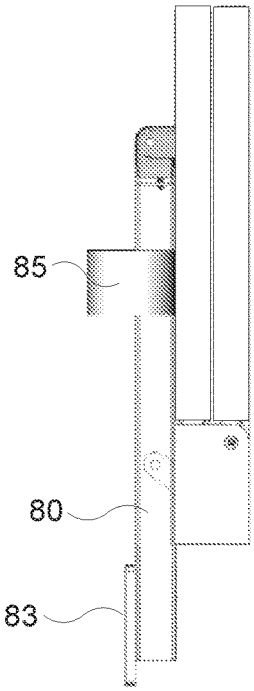
Figure 8A:
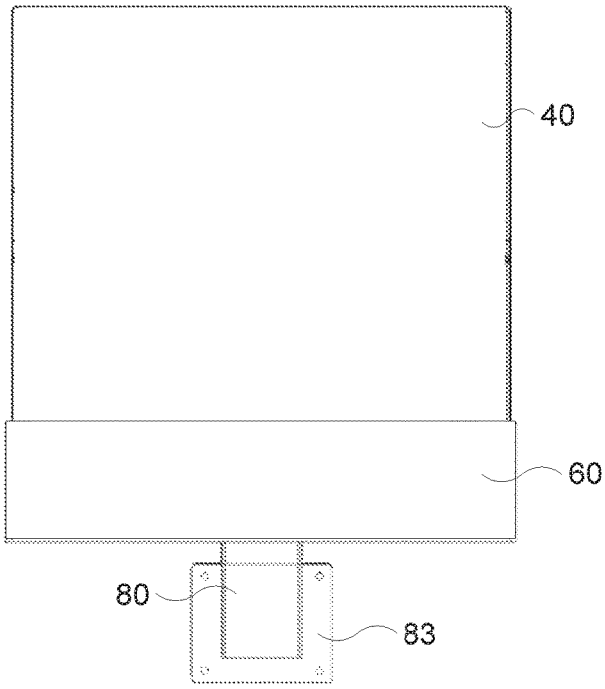

The chairs according to the present invention can be mounted in various ways such as to the pedestal 70, to a surface such as a wall, or even to a vertical portion of riser or step. FIGS. 8A to 8C show a chair 10 according to an exemplary embodiment of the present invention that is mountable on a riser (or stair). FIG. 8A shows a front view of the chair 10 in a closed configuration, FIG. 8B shows a side view, and FIG. 8C shows a top view. The chair 10 includes the vertical support 80 and a vertical plate 83 mountable on a riser. In the present embodiment, there is an optional cup holder 85 mounted to a side of the support 80 for use by an occupant in a chair behind this chair.

The chair 10 shown in FIGS. 8A to 8C can also be mounted on a wall. In some embodiments, the plate 83 is positioned further up on the support 80 for wall mounting and/or split into two plates on either side of the support 80. The support 80 is generally thin to maintain a low footprint. In the exemplary embodiment, the thickness of the support 80 (front to back) is 1.5 inches.

Figure 9A:
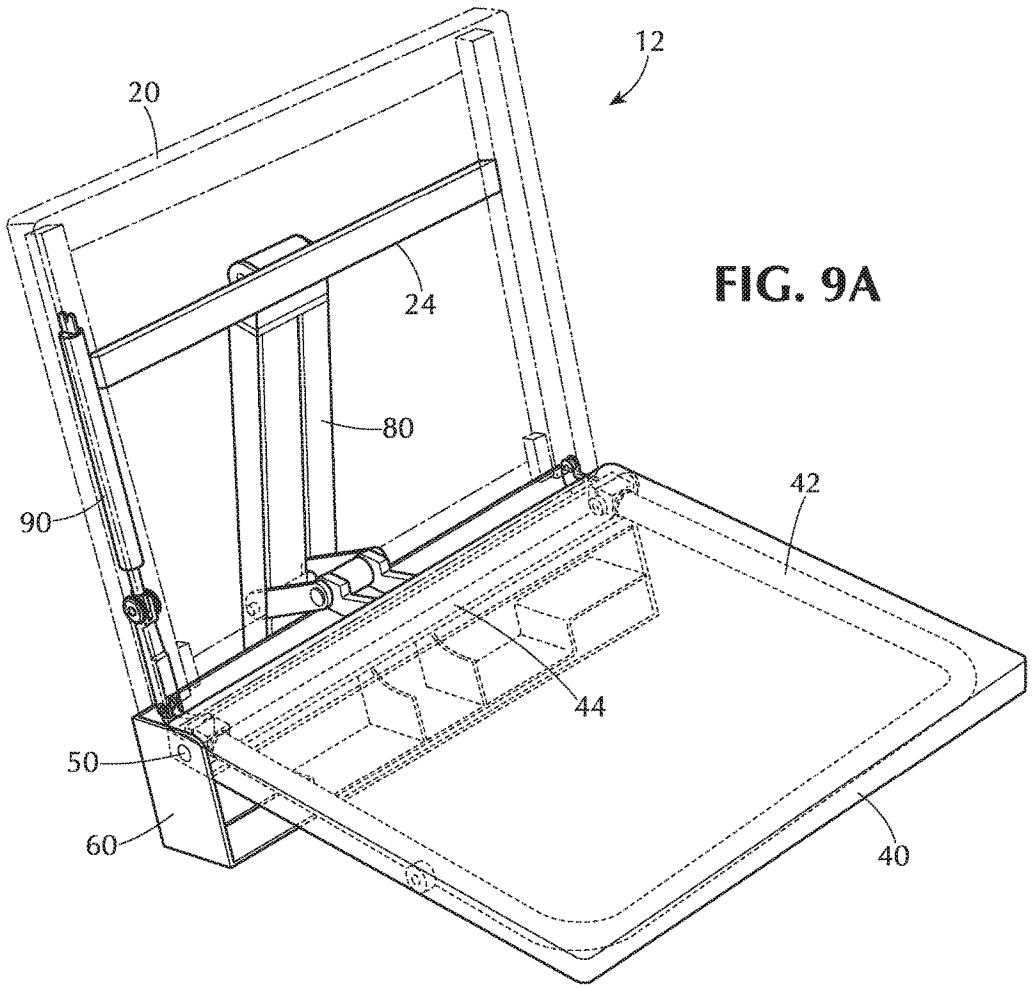
FIGS. 9A to 9E show another chair according to an exemplary embodiment of the present invention.
Figure 9B:
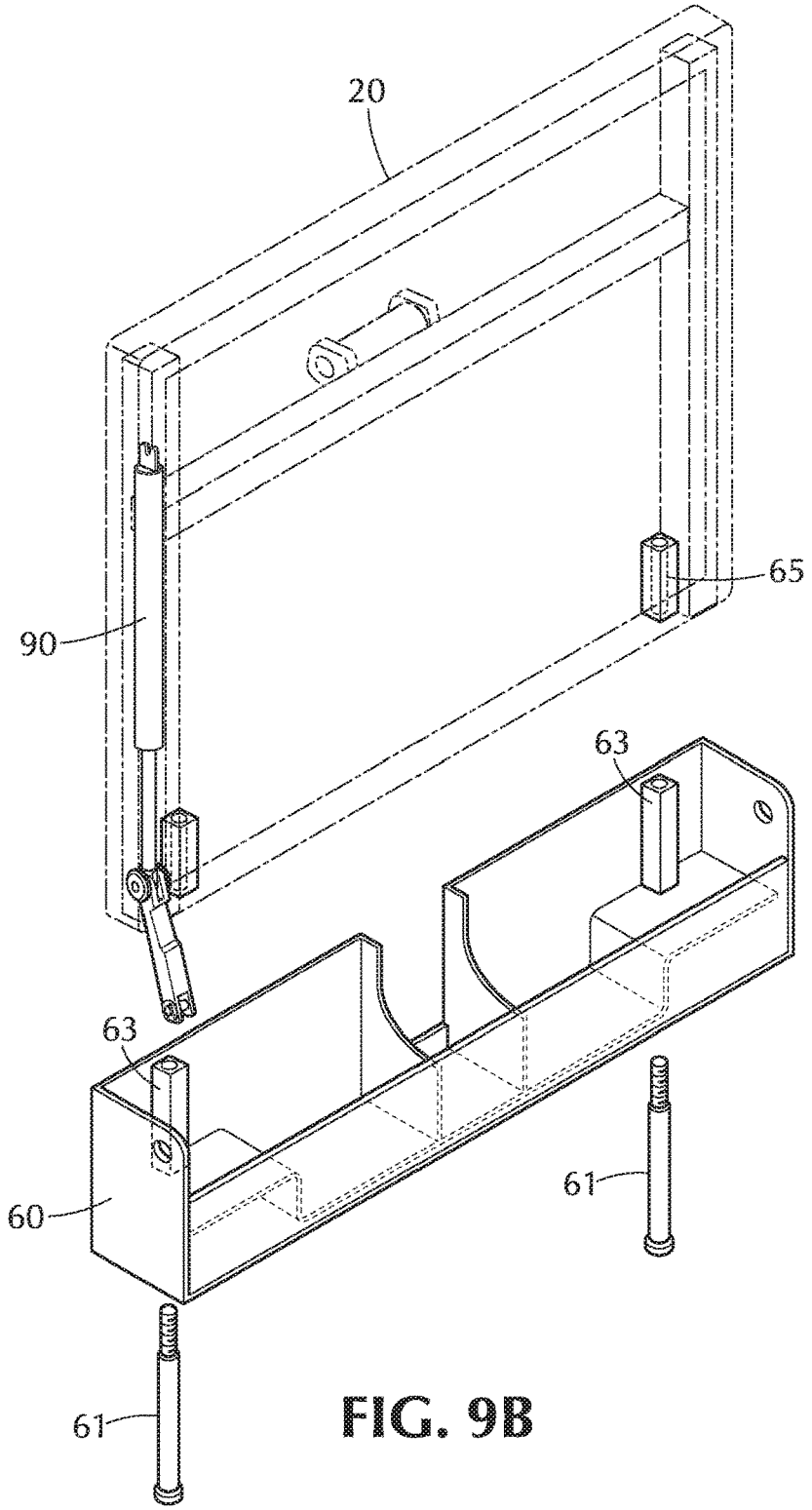

FIG. 9A show a cutaway view of another chair 12 according to an exemplary embodiment of the present invention. The chair 12 includes additional features and variations which may be employed in whole or in part in any of the embodiments. The chair 12 is shown mounted on the vertical support 80 which can be fixed to any one of a floor, riser, or wall as shown in previous figures. In this embodiment, the return mechanism 90 is housed within a frame member of the frame 22 of the backrest 20.

Figure 9C:
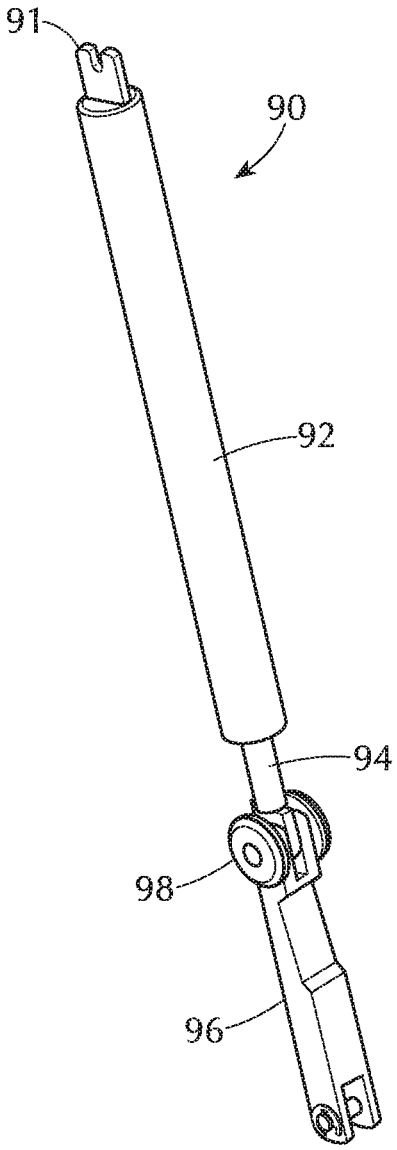

FIG. 9B shows a partial assembly view of the chair 12. Prior to connecting the backrest 20 to the cradle 60, the return mechanism 90 is slid into one or both vertical frame members of the backrest 20. As shown in FIG. 9C, the top of the return mechanism 90 has a catch 91 which rests against a pin in the frame member of the backrest 20 to restrain the return mechanism 90 in an upward direction. The backrest 20 is then secured to the cradle 60 via bolts 61 that extend through intermediate channels 63 in the cradle 60 into threaded channels 65 in the backrest 20.

Figure 13A:
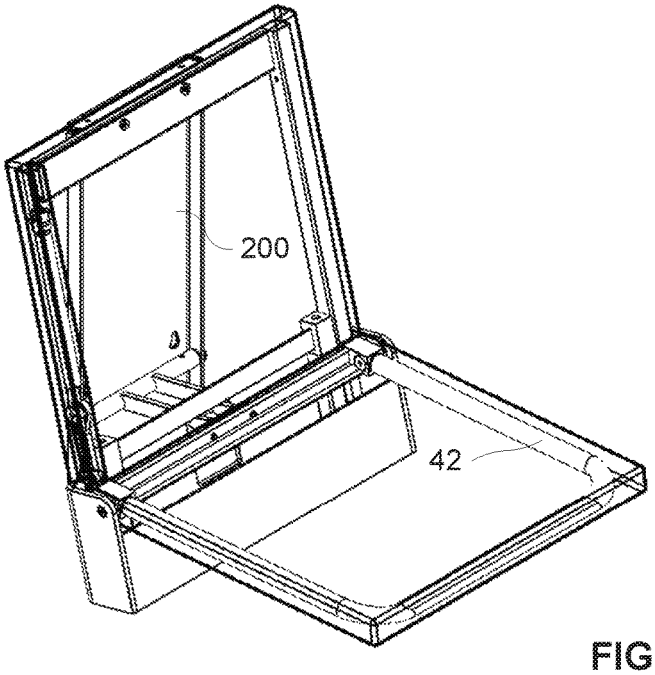
FIGS. 13 A and B show perspective and side cutaway views of a chair according to the present invention in the open configuration.
Figure 13B:
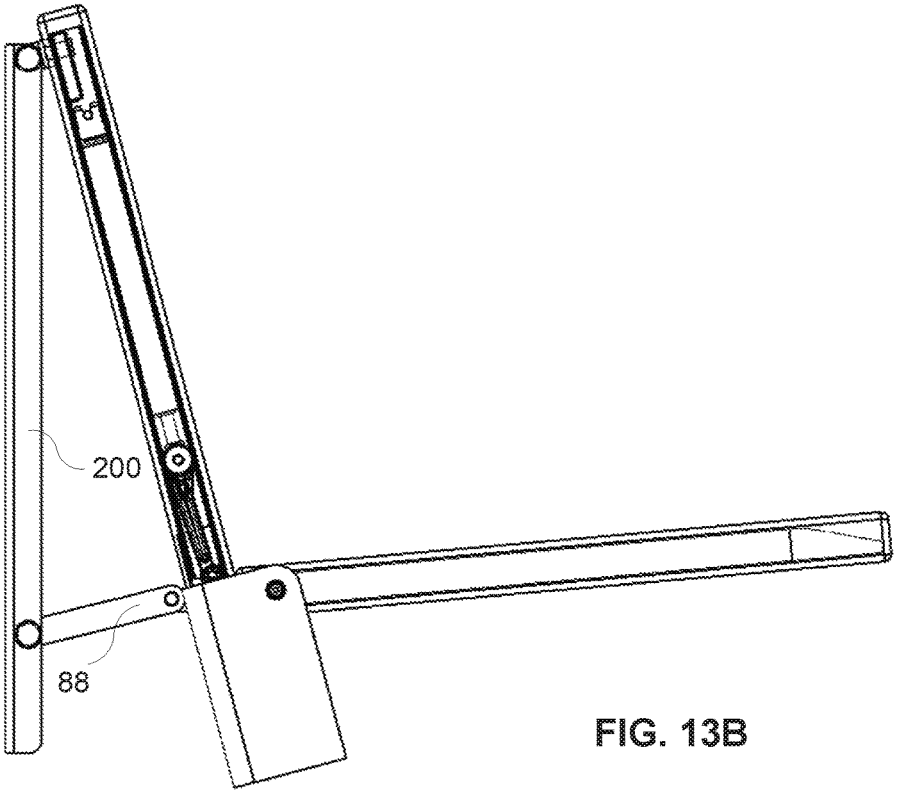
Figure 14C:
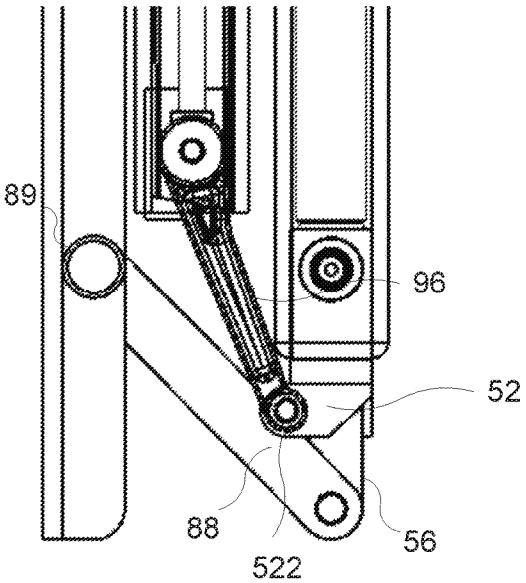
FIG. 14 A-C show perspective, side and side detail views of the chair of FIGS. 13 A and B in the closed configuration.
Figure 14B:
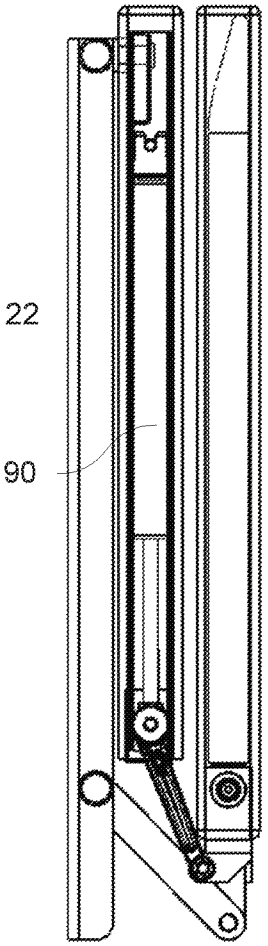
Figure 14A:
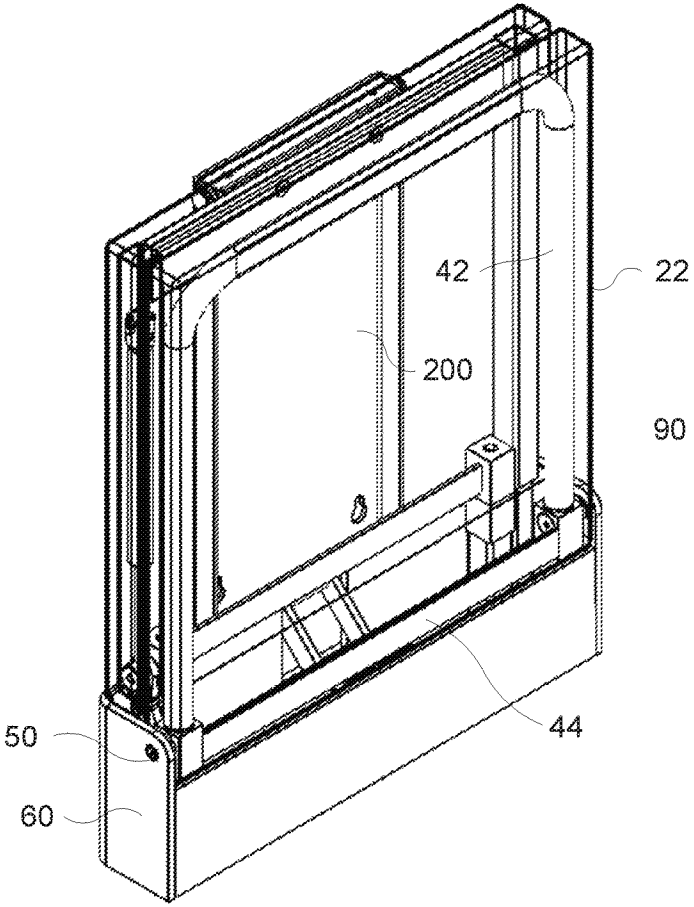
Figure 15:
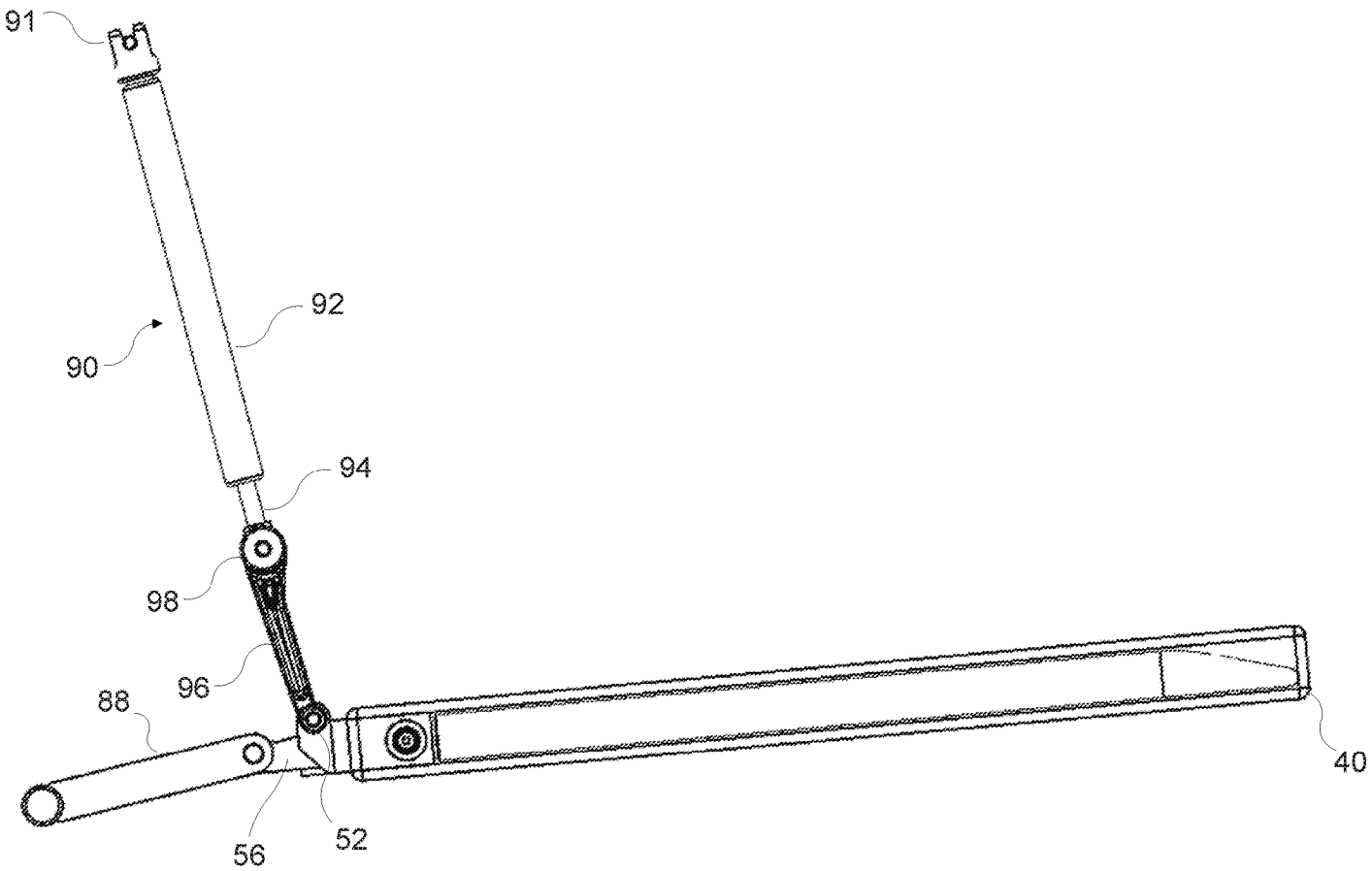
FIGS. 15 and 16 show side and perspective cutaway views of the seat bottom.
Figure 16:
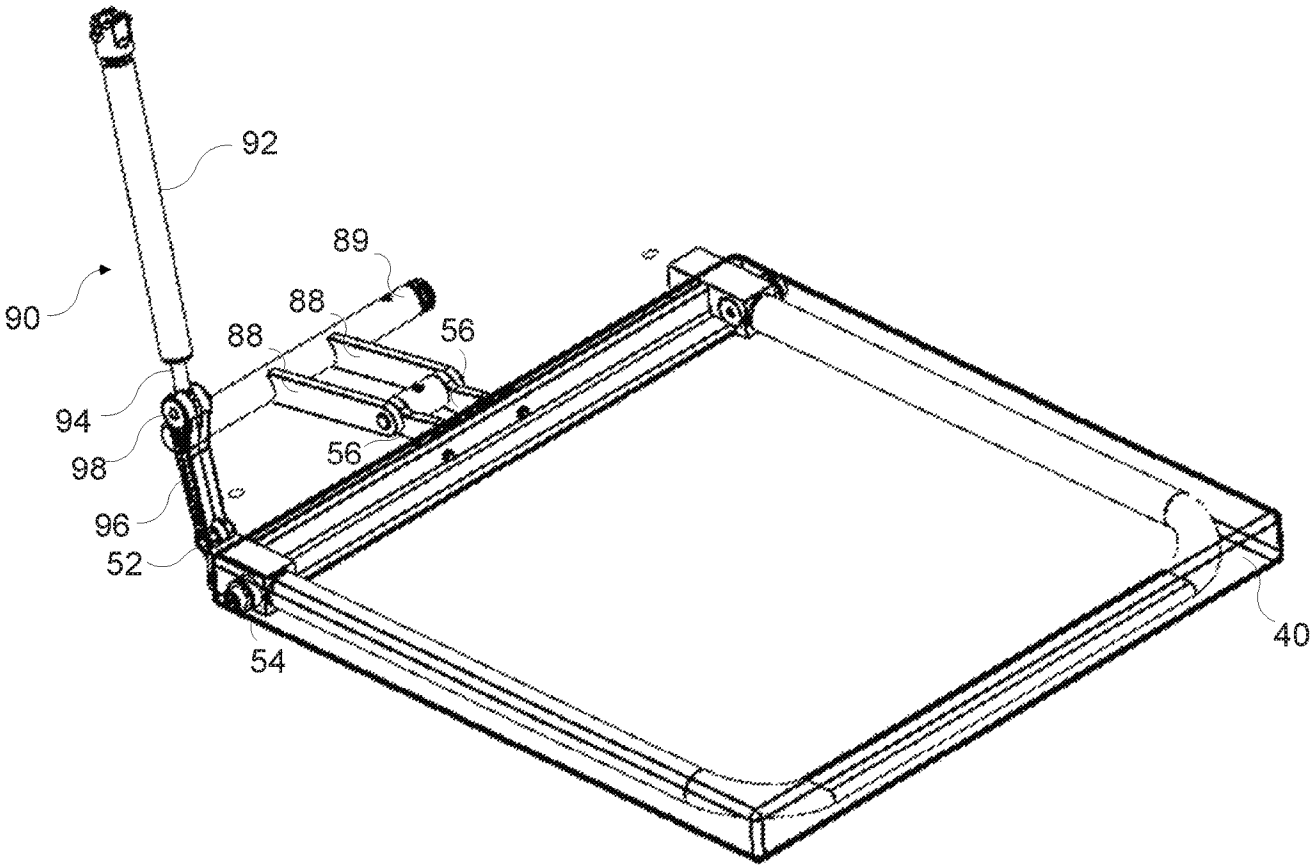

The return member 90 includes a cylinder 92, an extendable rod 94, and a linkage 96 hingedly connected to a bottom of the rod 94. The return mechanism 90 also includes at least one, preferably two, guide rollers 98 at the hinged connection between the rod 94 and the linkage 96. The rollers 94 have a diameter substantially equal to or slightly less than an interior dimension of the frame member of the backrest 20. The rollers 94 ensure smooth translation of the rod 94 within the frame and prevent rotation of the rod 94 and linkage 96 in the frame 22. As shown in FIG. 14B-C, the linkage 96 extends out of the backrest frame when the seat is in the closed position, but with the roller 98 remaining within the backrest frame. The linkage also includes a bend or curve or notch or other shallow portion on the front facing side to enable clearance in both the closed and open positions of the seat. In the open position of the seat (FIG. 13B), the majority or all of the linkage 96 is located within the backrest frame as the attachment 52 and specifically the pivot 522 is adjacent or within the lower end of the backrest frame.

Figure 9D:
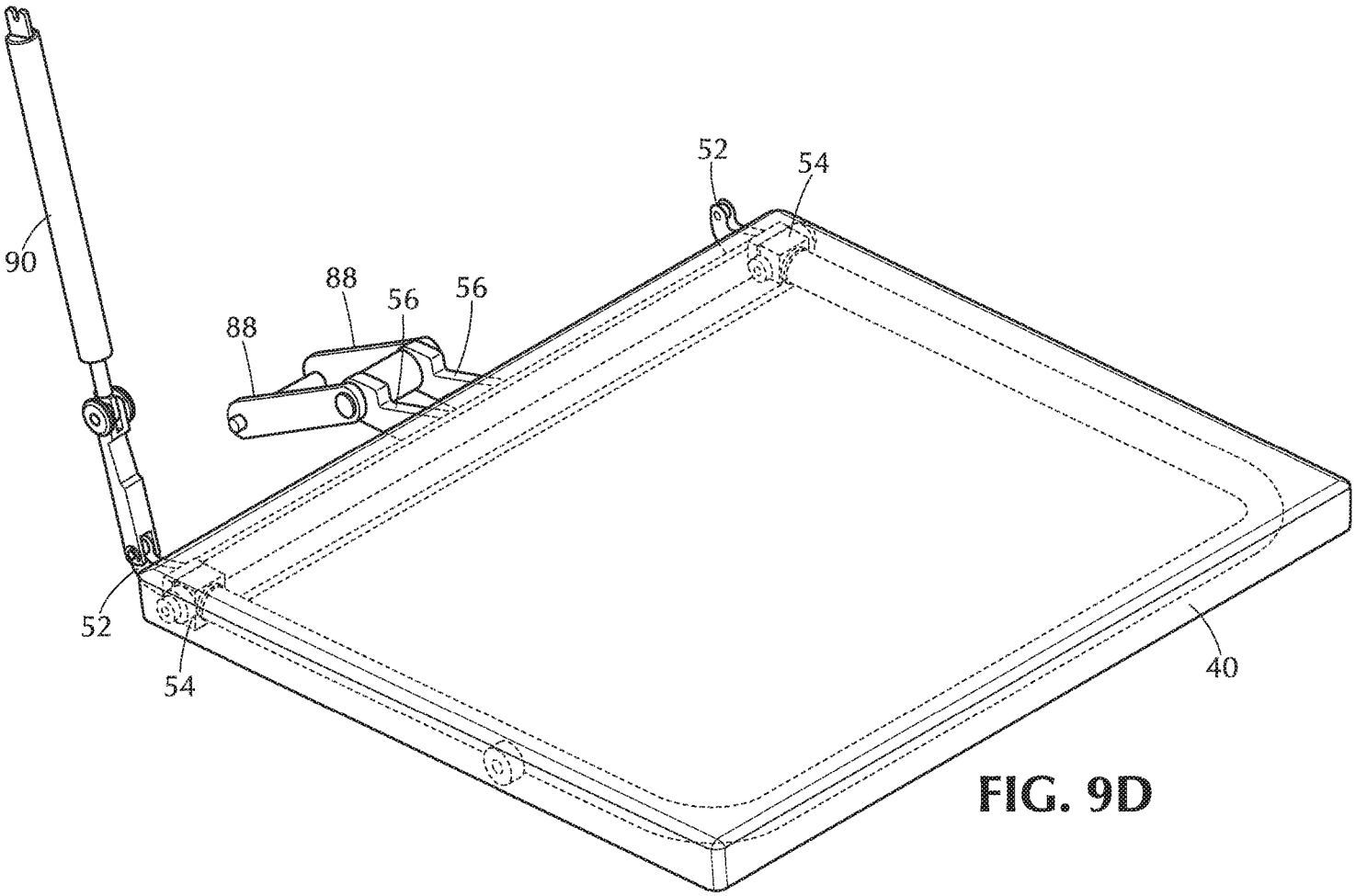
Figure 9E:
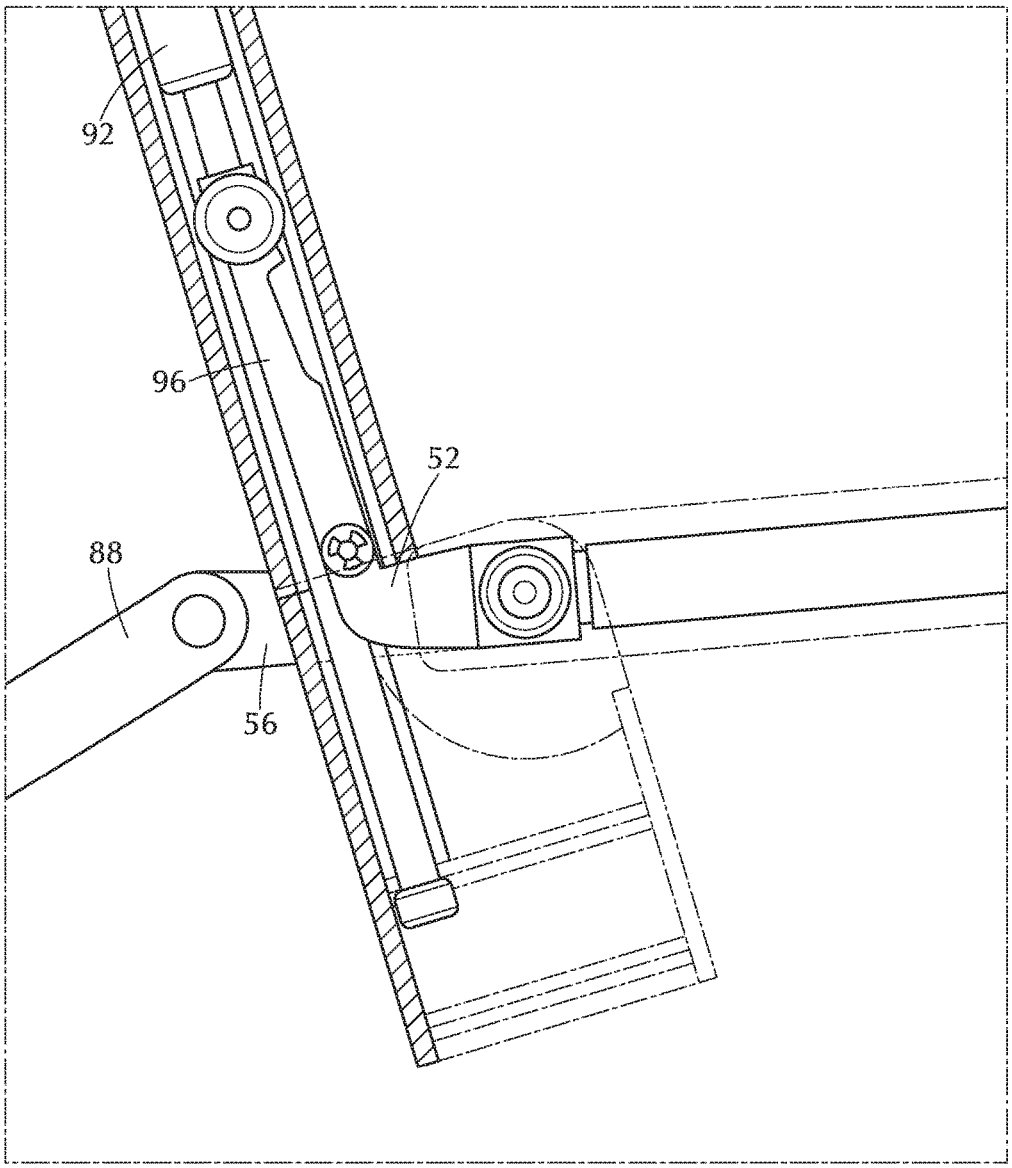

FIG. 9D shows a cutaway view of the seat bottom 40. The seat bottom 40 includes two brackets 56 that attach to linkages 88. The seat bottom 40 further includes two attachments 52. In this embodiment, the attachments 52 are integral with the joints 54 and have two functions. First, at least one of the attachments 52 is hingedly connected to the return mechanism 90. The return mechanism 90 provides a downward force on this attachment 52 to return the seat bottom 40 to the closed position. Second, each attachment 52 functions as a stop when the seat bottom 40 is in the open position. As further illustrated in FIG. 9E, each of the attachments 52 engages into the bottom of a frame member of the backrest 20 when the seat bottom 40 is in the open position. Interaction between the attachments 52 and the frame 22 of the backrest 20 stops rotation of the seat bottom 40 and defines the open position.

Figure 10A:
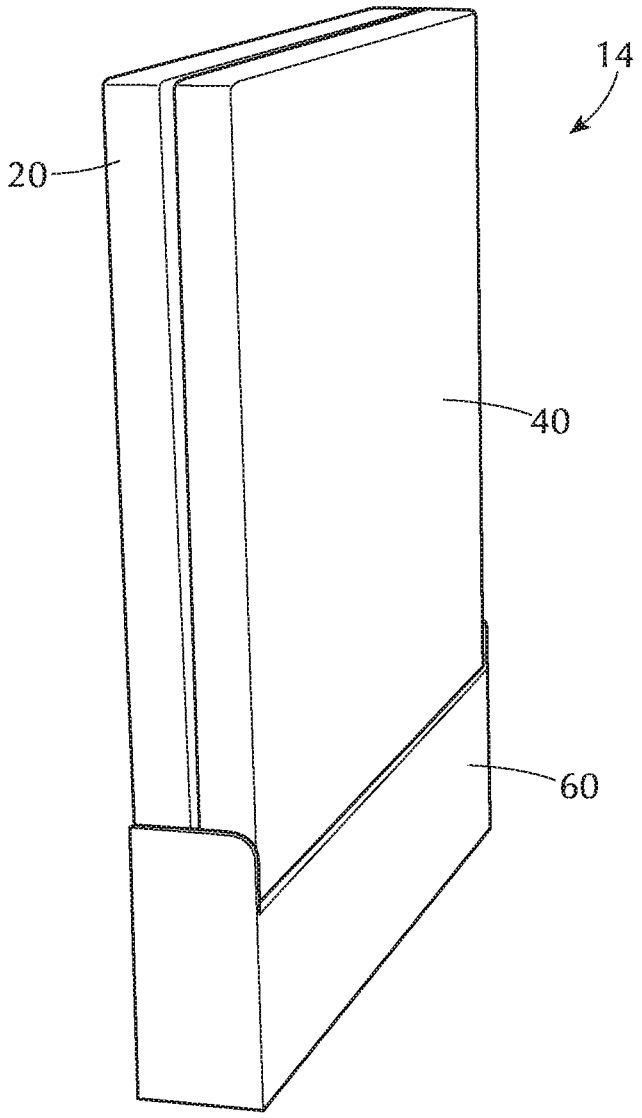
FIGS. 10A and 10B show a chair according to an exemplary embodiment of the present invention mounted on a wall.
Figure 10B:
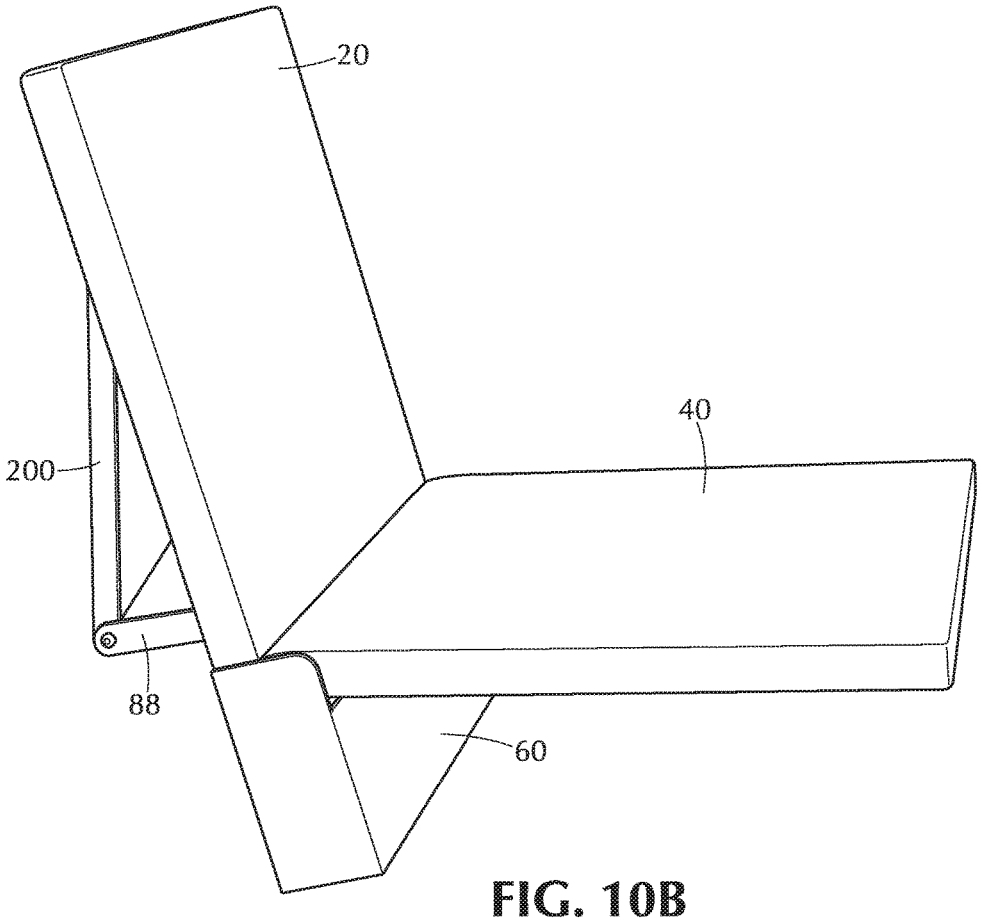

In some embodiments, in which it is desired to mount the chair even closer to a wall, an alternative flat mount may used. For example, FIGS. 10A and 10B show another chair 14 according to an exemplary embodiment of the present invention mounted on a wall. FIG. 10A shows the chair 14 in a closed configuration and FIG. 10B shows the chair 14 in an open configuration.

When mounted to a wall using this embodiment, the chair 14 operates in generally the same manner as the chairs 10/12 mounted to the vertical support 80. However, rather than the vertical support 80, the chair 14 includes a flat support or mounting plate 200 mounted to the wall about which the linkages 88 and backrest 20 rotate.

Figure 11A:
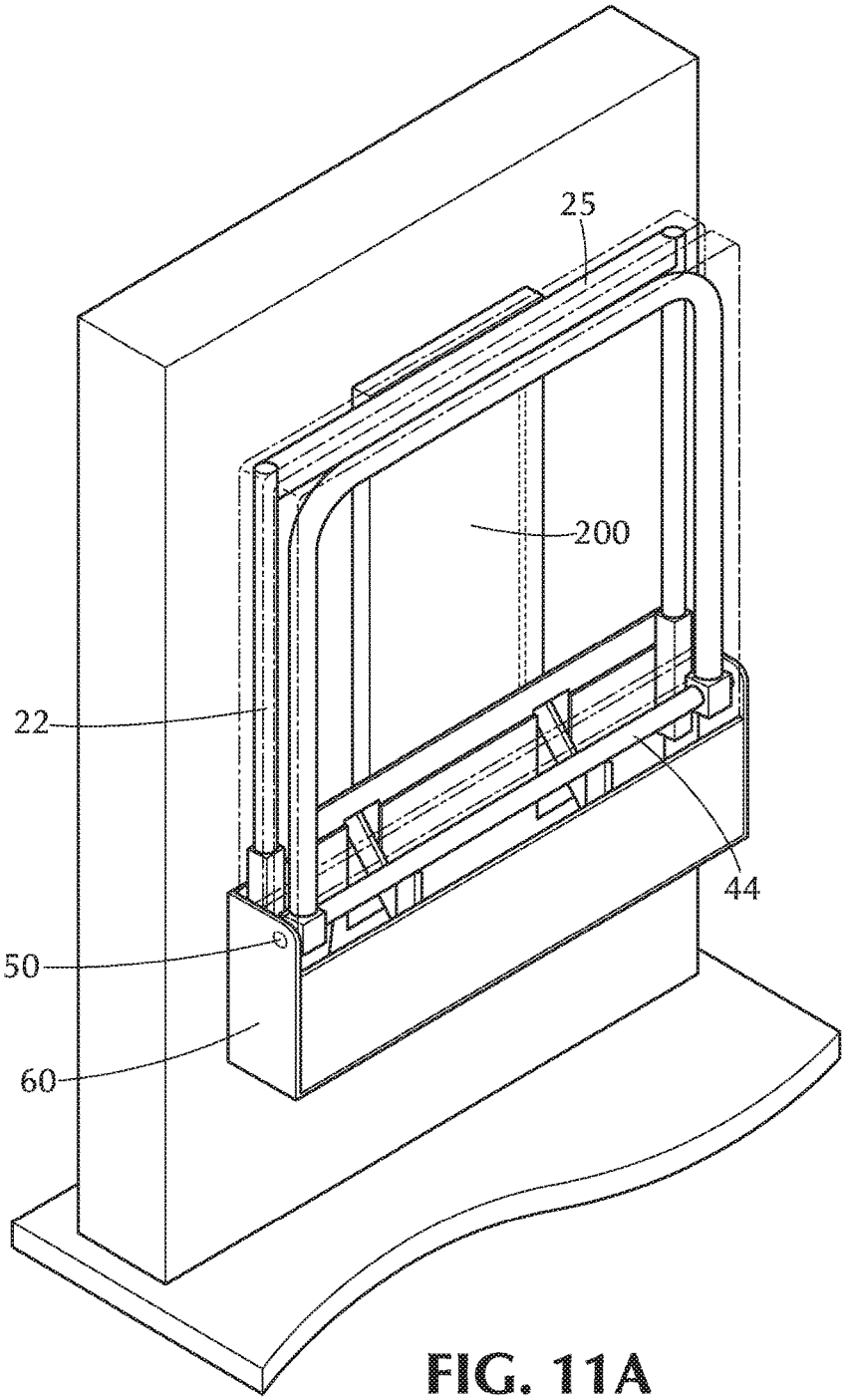
FIGS. 11A and 11B show cutaway views of the chair shown in FIGS. 10A and 10B.
Figure 11B:
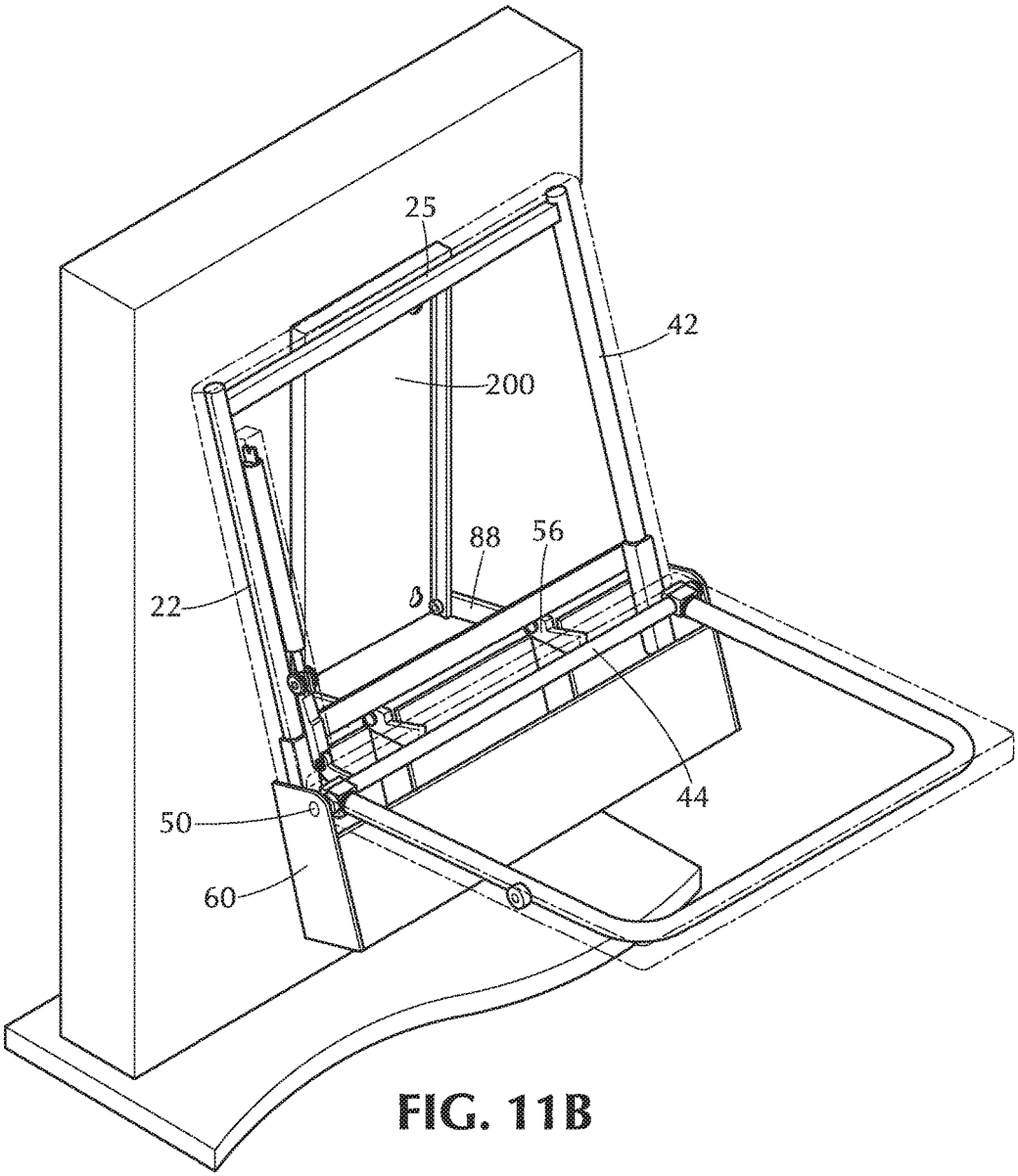

FIGS. 11A and 11B show cutaway views of the chair 14 shown in FIGS. 10A and 10B. FIG. 11A shows the chair 14 in a closed configuration and FIG. 11B shows the chair 14 in an open configuration. The frame of the seat back 20 includes a mounting bar 25 in the form of a top frame member which pivotably mounts to a top portion of the plate 200. The mounting plate 200 includes a rear surface against the wall (e.g., defining a rear plane) and a front surface adjacent to the seat back 20. Unlike the previous configurations in which the seat back 20 can at least partially rotate over the vertical support 80 (though still without interfering with space behind the chair/pedestal and/or extending beyond the rear surface/plane), the mounting bar 25 is moved upward in this configuration to avoid interference between the seat back 20 and the wall when reclined. The linkages 88 pivotably mount to a bottom portion of the plate 200.

Figure 12A:
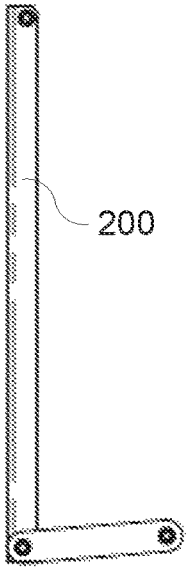
FIGS. 12A to 12C show a mounting plate of the chair shown in FIGS. 10A and 10B.
Figure 12B:
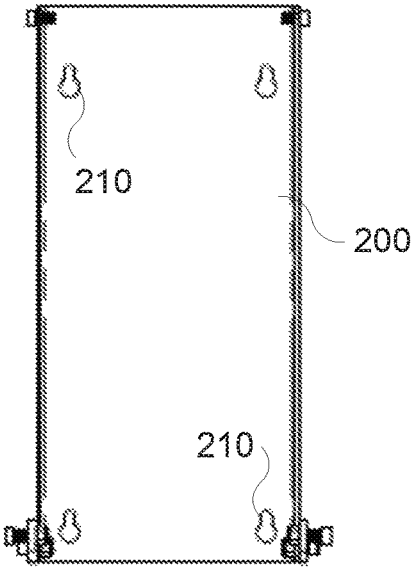
Figure 12C:
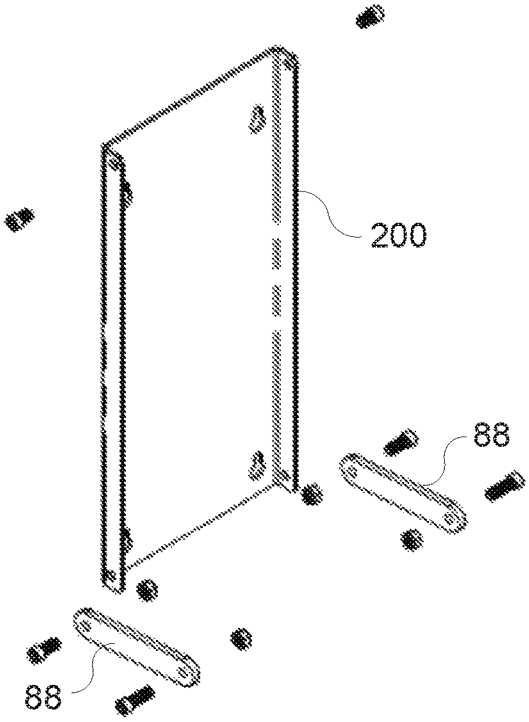

FIGS. 12A to 12C show the mounting plate 200 in more detail. FIG. 12A is a side view, FIG. 12B is a front view, and FIG. 12C is a perspective view. The mounting plate 200 includes one or more attachment holes 210 for securing the plate 200 to a vertical surface with fasteners. The linkages 88 are pivotably attached to the bottom of the plate 200 with fasteners. The mounting bar 25 is likewise pivotably attached to the top of the plate 200 with fasteners.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A chair, comprising:

a support;

a backrest including a backrest frame hingedly connected to said support;

a seat bottom including a seat frame, hingedly connected to said backrest, and a bracket extending rearward from the seat frame;

a linkage arm with a proximal end hingedly connected to said support at a fixed vertical position and a distal end hingedly connected to the bracket;

a return mechanism to return said seat bottom from an open position to a closed position;

wherein rotation of said seat bottom from the closed position to the open position causes, by way of interaction between said linkage arm and the bracket, said seat bottom to move forward from said support and said backrest to rotate about said support and recline.

2. The chair of claim 1, wherein a bottom portion of said backrest includes a cradle rigidly connected thereto, wherein said seat bottom is hingedly attached to said backrest via said cradle, said cradle being movable with respect to said support via the hinged connection between the backrest frame and said support.

3. The chair of claim 2, wherein in the closed position, the bracket is within said cradle.

4. The chair of claim 3, wherein in the closed position said linkage arm is at least partially within said cradle.

5. The chair of claim 1, wherein a width between a rear surface of said backrest and a bottom surface of said seat bottom in the closed position is equal to or less than a width of said cradle.

6. The chair of claim 1, wherein said support is a pedestal including a base mountable to a surface below the chair.

7. The chair of claim 6, wherein said support, said backrest and said seat bottom are substantially parallel in the closed position.

8. The chair of claim 6, wherein the pedestal is angled relative to the base such that when the surface is sloped, the pedestal extends vertically.

9. The chair of claim 1, wherein said support is a plate mountable against a vertical surface.

10. The chair of claim 9, wherein said support, said backrest and said seat bottom are substantially parallel in the closed position.

11. The chair of claim 1, further comprising an arm rest including a top section pivotably connected to a side of said backrest, and a bottom section pivotably connected at first end to the top section and pivotably connected at a second end to said seat bottom.

12. The chair of claim 1, wherein said seat bottom is rotatable at least ninety degrees about a pivot.

13. The chair of claim 12, wherein said seat bottom is rotatable up to one-hundred and fifteen degrees about the pivot.

14. The chair of claim 1, wherein said backrest is rotatable at least seven degrees about a pivot on said support.

15. The chair of claim 14, wherein said backrest is rotatable up to twenty-two degrees about the pivot on said support.

16. The chair of claim 1, wherein the return mechanism mounted within the backrest frame.

17. The chair of claim 16, wherein the return mechanism comprises a linkage having a pivot at either end thereof, a first end of the linkage hingedly connected at its pivot to a resilient element and a second end of the linkage hingedly connected at its pivot to said seat frame.

18. The chair of claim 17 wherein the resilient element is a gas spring.

19. The chair of claim 18 wherein the gas spring is mounted within the backrest frame and the linkage moves in and out of the backrest frame as the chair moves between open and closed positions.

20. The chair of claim 17 wherein the pivot of the second end is connected to a bracket which is connected to the seat frame.

21. A chair, comprising:

a support having a front surface and a rear surface;

a backrest adjacent to the front surface of said support and hingedly connected to said support via a first pivot fixed in position on said support, said backrest rotatable about the first pivot from an upright position to a reclined position without protruding beyond the rear surface of said support;

a second pivot in a bottom portion of said backrest; and a seat bottom hingedly connected about the second pivot, said seat bottom rotatable about the second pivot from a stowed position in which a top surface of said seat bottom is adjacent to said backrest to an open position;

wherein rotation of said seat bottom from the stowed position to the open position causes said seat bottom and said second pivot to move forward away from said support and said backrest to rotate about said first pivot to the recline position.

22. The chair of claim 21, wherein said support is one of a pedestal including a base mountable to a surface below the chair and a plate mountable against a vertical surface.

23. The chair of claim 21, further comprising an arm rest including a top section pivotably connected to a side of said backrest, and a bottom section pivotably connected at first end to the top section and pivotably connected at a second end to said seat bottom.

24. A row of chairs, comprising a plurality of the chairs of claim 21 mounted side-by-side.

25. The row of chairs of claim 24, wherein the support of each of the plurality of chairs is one of a pedestal or a mounting plate.

26. A chair, comprising:

a support;

a backrest hingedly connected to a top portion of said support;

a cradle rigidly connected to a bottom portion of said backrest, said cradle being movable with respect to said support via the hinged connection between said backrest and said support;

a seat bottom hingedly connected to said cradle including a bracket extending from a rear portion of said seat bottom;

a linkage arm with a proximal end hingedly connected to said support and a distal end hingedly connected to the bracket;

wherein rotation of said seat bottom from a closed position to an open position causes, by way of interaction between said linkage arm and the bracket, said seat bottom and said cradle to move forward from said support and said backrest to rotate about said support and recline; and a width between a rear surface of said backrest and a bottom surface of said seat bottom in the closed position is equal to or less than a width of said cradle.

27. The chair of claim 26, further comprising an arm rest including a top section pivotably connected to a side of said backrest, and a bottom section pivotably connected at first end to the top section and pivotably connected at a second end to said seat bottom.

* * * * *